US005732542A

United States Patent [19]

Mack et al.

[11] Patent Number: 5,732,542

[45] Date of Patent: Mar. 31, 1998

[54] TRANSPORT SYSTEM FOR TEXTILE BOBBINS AND SLEEVES

[75] Inventors: Karl-Heinz Mack, Weilheim; Friedrich Dinkelmann, Rechberghausen; Hermann Güttler, Uhingen, all of Germany

[73] Assignee: Zinser Textilmaschinen GmbH, Ebersbach/Fils, Germany

[21] Appl. No.: 782,759

[22] Filed: Jan. 13, 1997

[30] Foreign Application Priority Data

Jan. 16, 1996 [DE] Germany ..... 196 01 286.4

[51] Int. Cl.[6] ..... D01H 9/10; D01H 9/14

[52] U.S. Cl. ..... 57/281; 57/90; 57/266; 57/274; 242/35.5 A

[58] Field of Search ..... 57/90, 267, 266, 57/274, 275, 281, 268; 242/35.5 A

[56] References Cited

U.S. PATENT DOCUMENTS 4,930,302 6/1990 Yamamoto et al. ..... 57/281
5,010,725 4/1991 Yasui et al. ..... 57/90
5,365,728 11/1994 Mack ..... 57/90
5,509,614 4/1996 Nishikawa et al. ..... 57/90
5,628,174 5/1997 Mack et al. ..... 57/90

FOREIGN PATENT DOCUMENTS 0 314 631 5/1989 European Pat. Off. .

*Primary Examiner*—William Stryjewski
*Attorney, Agent, or Firm*—Herbert Dubno

[57] ABSTRACT

A transporter for textile plants having upstream machines providing full bobbins to downstream machines returning core sleeves to the upstream machines. The transport system has a suspension track extending in a loop around a plurality of the downstream machines for each upstream machine and provided with switches and shunts which allow reconfiguration of the loop which can have a diverting stretch for use when the downstream machine is shunted and for including one or more machines of the adjacent loops when desired in the first-mentioned loop. In all configurations, the path length is substantially the same and the length of the transporter is only slightly less so that a gap is provided between the leading and trailing ends of the transporter.

12 Claims, 7 Drawing Sheets

TRANSPORT SYSTEM FOR TEXTILE BOBBINS AND SLEEVES

FIELD OF THE INVENTION

The present invention relates to a transport system for bobbins and sleeves between at least two upstream machines effecting a textile process and a multiplicity of downstream machines for carrying out a further stage in the process and, particularly, for processing textile materials like sliver, roving and yarn, the system having a track upon which a bobbin/core transporting is displaceable in a loop along the downstream machines. By way of example, the upstream machines can be roving frames which draw sliver from cans of a can field and wind roving onto the cores or sleeves to form wound or full bobbins while the downstream machines can be ring spinning machines which receive the full bobbins and spin the roving therefrom into yarn, thereby emptying the cores or sleeves so that the sleeves can be returned to the roving frame. The track can be a suspension track along which the transporter travels, the transporter being, for example, a train of hanger carriages, each of which can carry a hanger from which a bobbin or sleeve can be suspended. The invention also relates to a textile plant having such upstream machines and downstream machines and provided with the transport loop and the transporter traveling around that loop.

BACKGROUND OF THE INVENTION

It is known from EP 0 314 631 B to provide two types of machines which can process roving successively, for example, a roving frame and a ring-spinning frame and to connect them by a track or rail system. In this arrangement an endless transport unit in the form of a chain circulates between the machines of the two types so as to carry roving bobbins from the roving frame to the ring-spinning machine and the empty sleeves back from the ring spinning machines to the roving frame. The track forms a loop between the ring-spinning machines so that, at all of the working stations of the ring-spinning machines forming part of the loop, roving bobbins can be engaged by the service person and transferred over a short path to the spinning station and, conversely, empty sleeves can be removed from the stations and transferred to the endless chain. It is customary in this and similar systems for a single roving frame to service a fixed group of ring-spinning machines with roving bobbins. From time to time, however, it is necessary to alter the number of ring-spinning machines which are associated with a roving frame. In a closed loop system with an endless transport chain, this cannot be done without significant mounting, disassembly and track and transporter alteration.

OBJECTS OF THE INVENTION

It is, therefore, the principal object of the present invention to provide an improved transport system for bobbins and sleeves in a system having upstream and downstream machines as has previously been described, whereby modifications to associate different numbers of downstream machines with each upstream machine can be greatly simplified.

Another object of the invention is to provide an improved textile plant with greater versatility and ease of alteration of the transport configuration between an upstream machine and a plurality of downstream machines.

It is also an object of the invention to provide an improved textile plant which facilitates association of varying numbers of downstream machines with each upstream machine.

SUMMARY OF THE INVENTION

These objects are attained, in accordance with the invention by a combination of the following features:

(a) The tracks are subdivided by means of switches (switch tracks) and branches or shunts into suspension track loops each of which travels past an upstream machine, e.g. a roving frame and a plurality of downstream machines, e.g. ring-spinning frames, with the loop configuration being alterable by means of the switches and the shunts.

(b) Each of the shunts is brought into play by respective switches and at least one such shunt can bridge across the stretches of track of two downstream machines flanking a shunted downstream machine so that the track of the latter is cut out of the loop.

(c) The bobbin/core transporter of the loop is interrupted, i.e. is not endless, but rather has a pair of ends spaced apart by a small distance hereinafter referred to as a gap. This open transporter can have its free ends so close together that it effectively extends over most or substantially all of the loop and thus acts as a quasi-endless transporter. Preferably the bobbin/core transporter is a suspension train of carriages from which the bobbins and sleeves can depend.

More particularly the textile plant can comprise:

- at least two upstream machines receiving respective cores and winding bobbins thereon;
- a multiplicity of downstream machines for receiving wound bobbins and emptying the cores from the bobbins; and
- a transport system connecting each of the upstream machines with a respective and variable plurality of the downstream machines in a respective transport loop, the transport system comprising:
  - respective tracks extending along the downstream machines of the respective plurality and past the respective one of the upstream machines,
  - respective shunts and switches connected to the tracks and selectively operable to vary a configuration of the respective transport loop to exclude a track of one of the respective plurality of upstream machines and to include a track of an upstream machine of another loop while maintaining substantially an original path length, and
  - an elongated bobbin/core transporter displaceable along the respective transport loop for receiving wound bobbins from the respective upstream machine, for delivering wound bobbins to the downstream machines along the respective transport loop, for receiving cores from the respective downstream machines along the respective transport loop, and delivering the cores to the respective upstream machine, the transporter having a length slightly smaller than the path length.

Because of the presence of a gap between the ends of the quasi-endless bobbin/core transporter, the path of the latter can embrace different groups of the downstream machines, depending upon the operation of the switches and the shunts so that the number of downstream machines assigned to the loop servicing one upstream machine can be increased or decreased from the number customarily provided.

By matching the length of the loop path to substantially the unaltered length of the bobbin/core transporter, the gap length can remain relatively short and no extensive wait for passage of the gap need impede the transfer of bobbins of the downstream machines or the removal of cores or sleeves therefrom. As a practical matter, therefore, the presence of a gap does not slow down the process and the operation of the plant can proceed in all respects as if the transporter is truly continuous and endless.

Because of the presence of the gap or an opening in the transporter, operation of the switches is simplified, i.e. the switches can operate on the fly when the gap is in the region of the switch to be operated without any need to disassemble the track or the transporter or interference by the transporter to the switching operation. The versatility and flexibility of the transport system is thus greatly enhanced.

The short circuiting of track segments or the opening of track segments associated with the downstream machines or a diverting loop or stretch can readily adjust the path length to the length of the transporter upon changes in path configuration. The gap in the quasi-endless suspension train forming the transporter also has the advantage that slight differences in the path length for different configurations can be automatically compensated.

It is of course conventional to provide suspension tracks on which a plurality of short suspension carriage trains are displaceable and which can have hangers for receiving the bobbins and/or sleeves or cores, but when short trains of this type are normally provided in a long track system, the controls for the trains must be relatively complex and expensive. By providing a single transporter on each loop with a length that is just shorter than the path length of the loop, complex control systems are eliminated and the transporter can be circulated continuously. The transporter itself can be of simplified construction. Resetting of the switches is required only in the infrequent case in which a change in the path configuration and the number of downstream machines to be associated with an upstream machine is necessary.

When the travel path of a bobbin/core transporter is to be expanded to a further downstream machine, which had previously been serviced by an upstream machine in a different loop, the loop including the new machine must be correspondingly matched to the length of the transporter which can be effected by shunting the transport track of an intermediate downstream machine so that the stations thereof can still be reached by the service personnel from the track stretches of two downstream machines.

When, however, the loop around the downstream machines is shortened by omission of a downstream machine from the set, e.g. for its incorporation into the set of downstream machines serviced by a different loop and a different upstream machine, a diverting stretch is provided to receive the length of the transporter corresponding to the downstream machine which has been dropped out, the diverting loop being rendered accessible by the opening of a shunt via the switch tracks for the shunt. The use of the two shunts can, of course, also be combined to allow, for example, the diverter loop to be opened and a downstream machine track to be shunted simultaneously if desired.

In all cases, however, the transporter remains open, i.e. a gap is provided between the ends thereof, the gap being of a sufficient length to allow operation of the switches as the gap passes them. Apart from this consideration, the gap should be as short as possible and the transporter as long as possible so that the span over which the hangers do not pass the service personnel for mounting of a bobbin on the downstream machine or the removal of a core or sleeve from the downstream machine is as short as possible. This prevents any limitation in the speed of operation of the system. Small differences in the path length, of course, can be compensated by the spacing between the ends of the bobbin/core transporter.

Since the transporter must, over a part of its travel, be shoved forwardly, it is advantageous to form the transporter as a chain of links or carriages which are rigid in a forward shoving direction and preferably has a minimum play both on traction and in thrust along the path.

BRIEF DESCRIPTION OF THE DRAWING

The above and other objects, features, and advantages will become more readily apparent from the following description, reference being made to the accompanying drawing in which.

SPECIFIC DESCRIPTION

The invention is described below by way of an example of a spinning plant comprised of roving frames and ring spinning machines. The invention is, however, applicable to other systems using upstream machines and downstream machines, for example, combinations of drafting frames and roving frames and combinations of ring spinning machines and twisting machines.

Figure 1:
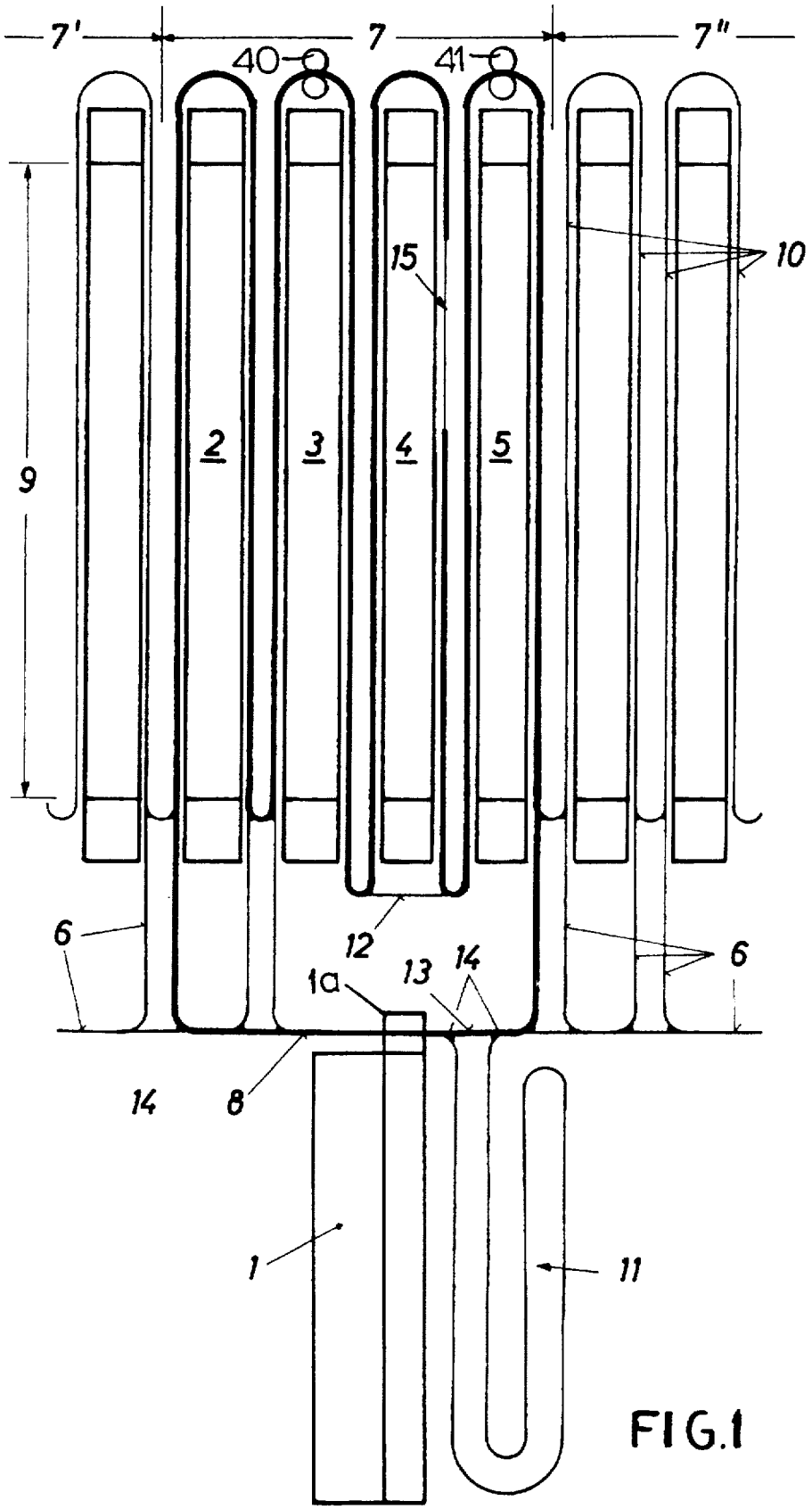
FIG. 1 is a plan view of a portion of a textile plant having at least two upstream machines in the form of roving frames and a multiplicity of downstream machines in the form of ring-spinning frames, coupled by a track system having loops connecting the downstream machines and showing one configuration of such a loop according to the present invention.
Figure 2:
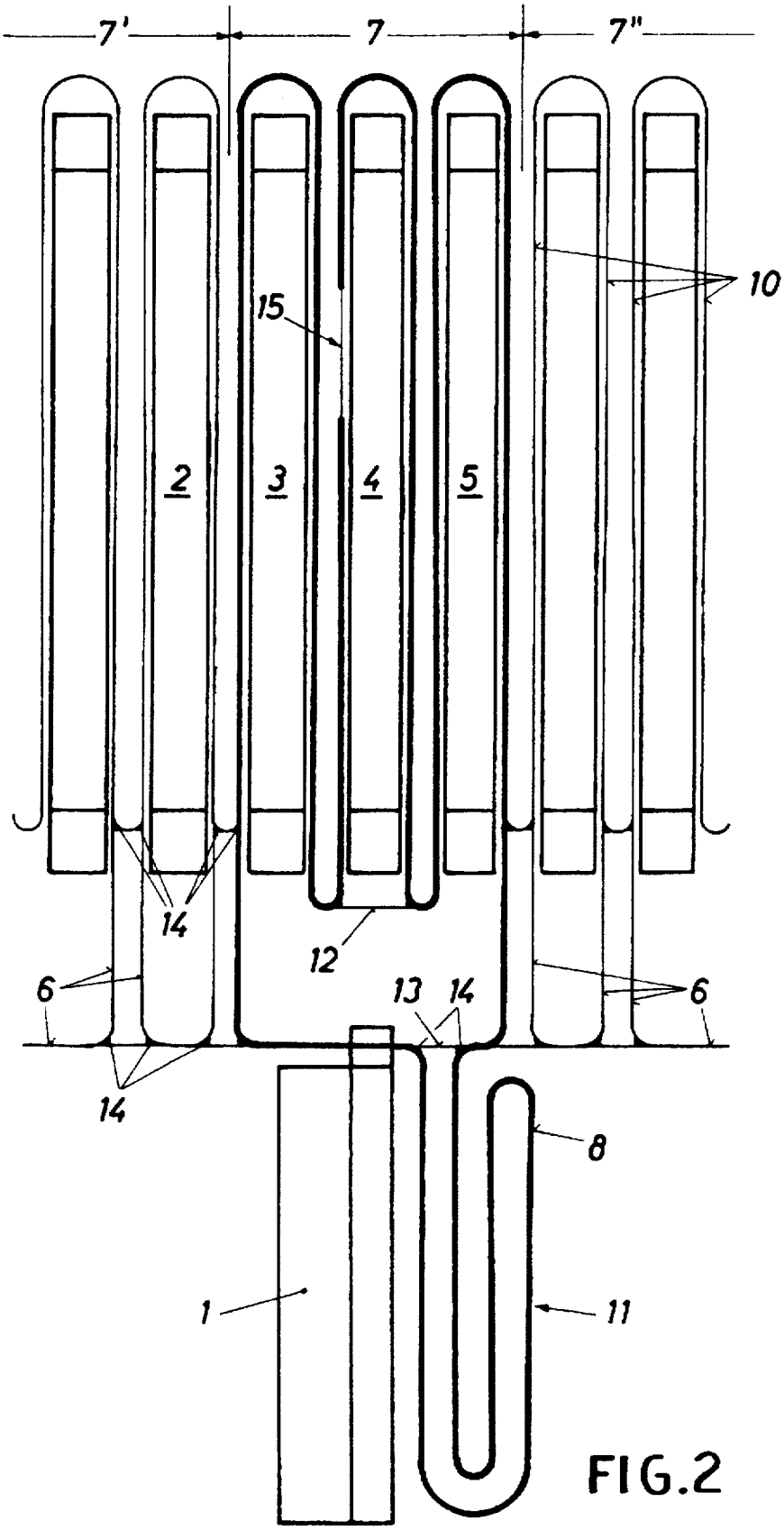
FIG. 2 is a view similar to FIG. 1 showing a loop associated with one upstream machine and encompassing three downstream machines.
Figure 3:
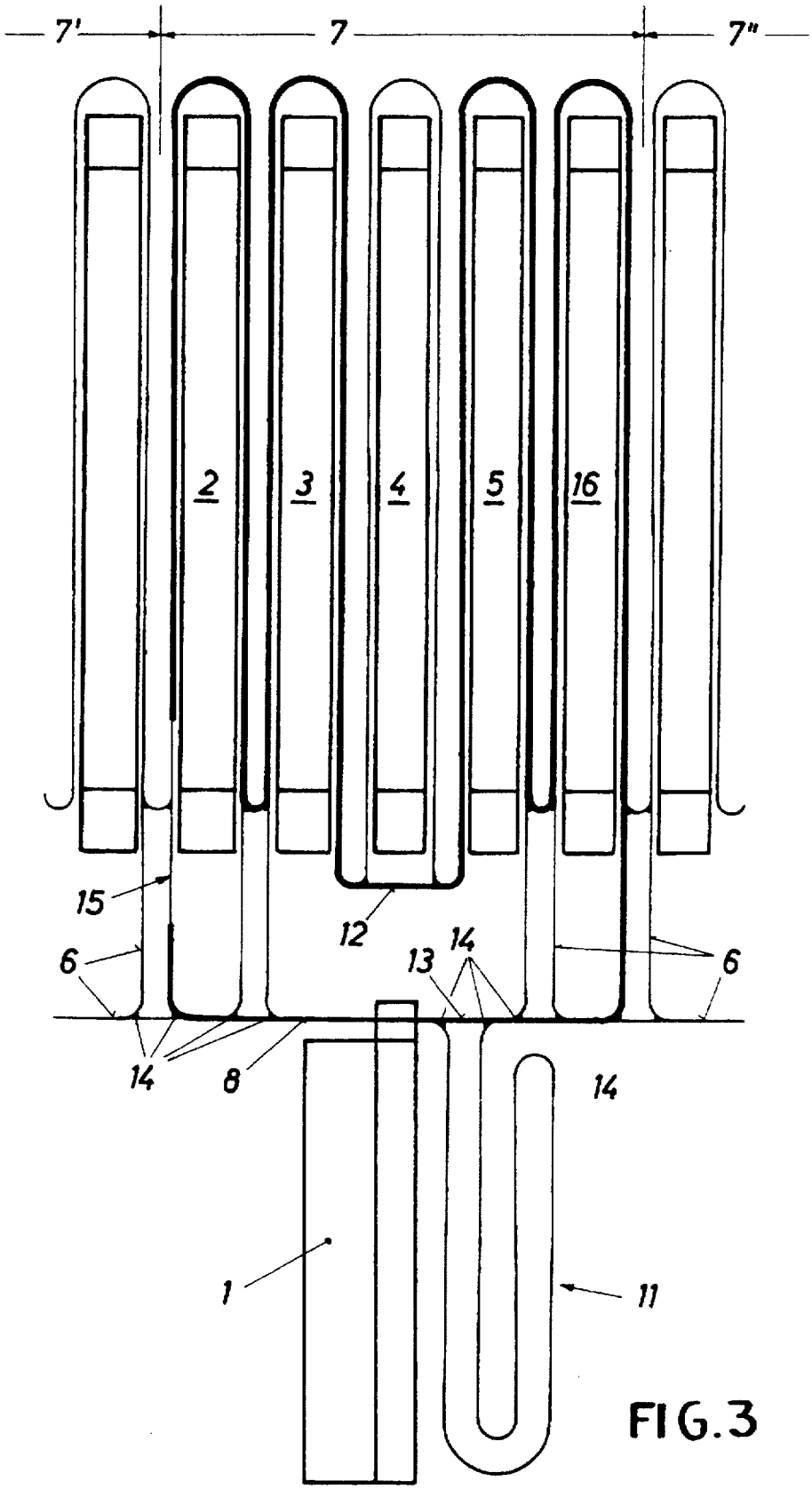
FIG. 3 is a view similar to FIGS. 1 and 2 showing a loop which enables five downstream machines to be coupled with the one upstream machine.
Figure 7:
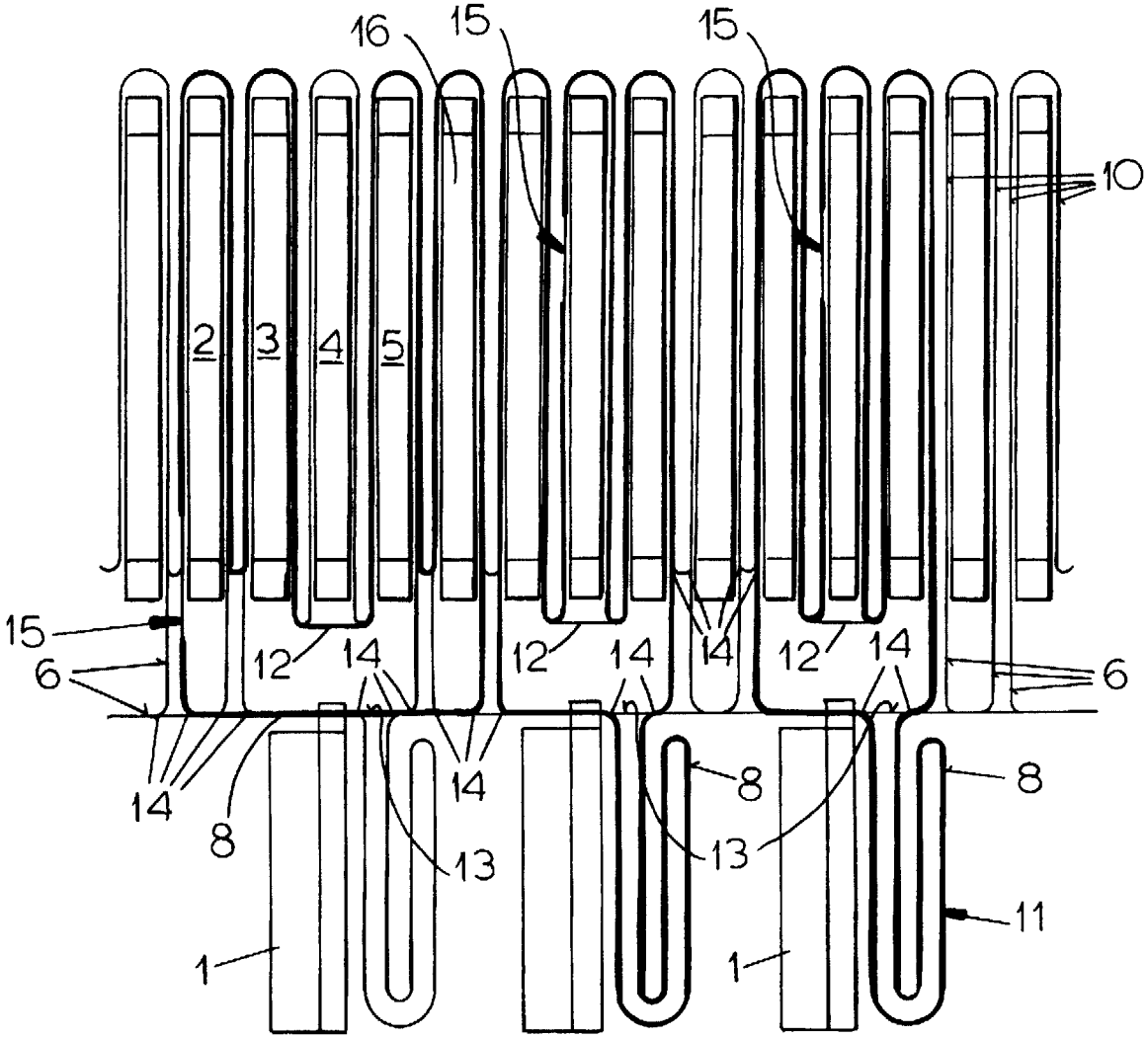
FIG. 7 is a plan view of a system similar to FIGS. 1–3 but showing the plurality of roving frames.

The plan views of FIGS. 1–3 show an example of a system wherein a roving frame 1 constitutes the upstream machine and a plurality of ring spinning machines 2–5 constitute the downstream machines. While FIGS. 1–3 show three different configurations into which the plant can be set by the branch tracks and switches, a number of different configurations are shown in FIG. 7, from which it is clear that the plant comprises at least two upstream machines.

The bobbin/sleeve transporter 8 travels in suspension tracks 6 to carry finished roving bobbins from the roving frames 1 to the regions of the ring spinning frames 2 to 5 where the finished roving bobbins are transferred to the working stations or holding stations and from which empty sleeves or bobbin cores, from which roving has been withdrawn in spinning the roving to yarn, are carried back to the roving frame by the bobbin/sleeve transporter. (In the roving frame, sliver drawn from sliver cans can be subjected to drafting and then wound as roving on the sleeves or cores to form the roving bobbins.)

The suspension tracks 6, which are disposed generally at the level of the creel of the ring spinning machines 2 to 5, are closed into suspension track loops 7, 7', 7" by correspondingly positioned switches (switch tracks) 14, each of which is arranged between the roving frame and a respective ring spinning frame. The suspension tracks 6 are so arranged that a respective pass or stretch 10 of the track is provided on either side of the working length 9 of the respective ring spinning frame, i.e. the stretches of each track 6 straddles the respective ring spinning frame as seen in plan view (FIGS. 1–3 and 7). At a location along each suspension track loop 7, etc. (see especially FIG. 7), which is always traversed by the bobbin/sleeve transporter 8, a diverting stretch 11 is provided with a length equal approximately to a length corresponding to the two stretches 10 of the track 6 along the working length 9 of a ring spinning machine. The suspension track loop 7, etc. is also provided with shunt tracks 12, 13 which can be brought into operation or disconnected by respective switches 14.

The bobbin/sleeve transporter 8 can, as is conventional with suspended bobbin and sleeve systems, be composed of a suspension carriage train of carriages articulated to one another and provided with hangers from which the full bobbins and empty cores or sleeves can be detachably suspended. The train can be driven by spaced apart pairs of friction drive rollers spaced along the tracks 6. The bobbin/sleeve transporters 8 of the respective roving frames are not coupled endlessly together; rather a short gap 15 is left between ends of the respective transporters.

The transfer of full bobbins from the roving frames to the respective bobbin/sleeve transporters 8 and from the bobbin/sleeve transporters 8 to the respective ring spinning machines can be effected by hand by service personnel positioned at the machines or by automatic doffing and donning mechanisms known in the art and thus not further described herein. A combination of both modes of transfer is also possible.

Assuming that a normal mode of operation or plant configuration has four ring spinning machines 2, 3, 4, 5, serviced by one roving frame 1, the configuration can correspond to that of FIG. 1. As can be seen in bold from this Figure, the switch tracks 14 are so set that the loop 7 runs through the roving frame 1, along the left-hand stretch of the ring spinning frame 2, along the right-hand stretch of the latter, along the left-hand stretch of the ring spinning frame 3, along the right-hand stretch 10 of spinning frame 3, along the left-hand stretch of ring spinning frame 4, and along the right-hand stretch of ring spinning frame 4 to the gap 15. The trailing end of the bobbin/sleeve transporter 8 extends from the opposite side of the gap along the right-hand stretch 10 of spinning frame 4, along the left-hand stretch of spinning frame 5, and along the right-hand stretch of spinning frame 5 to the roving frame 1. The shunt track 12 is out of service but shunt track 13 is effective to shunt the diverting stretch 11. The length of the bobbin/sleeve transporter 8 is very roughly 8 times the length of a stretch 10 along the working length 9 of the ring spinning frame.

When, as shown in FIG. 2 the left-most ring spinning frame 2 of one group is to be incorporated in the loop 7' of another roving frame or is to be temporarily out of service (see also FIG. 7), the switches 14 are reset so that the bobbin/sleeve transporter 8 assumes the path shown in bold in FIG. 2 for the loop 7. In this case the transporter 8 passes from the roving frame 1 directly to the left-hand side of ring spinning frame 3 and the balance of the loop proceeds as described in connection with FIG. 1 except that the switches for shunt track 13 disconnect the latter and switch the transporter path to include the diverter stretch 11. The latter thus receives the length of the transporter 8 which no longer passes along the ring spinning frame 2. Since the overall path length remains substantially the same, there is no material change in the length of the gap 15.

If, on the other hand, the loop 7 is to encompass a ring spinning machine 16 formerly of the loop 7", switches of the two loops are reset as shown in bold in FIG. 3 so that the bobbin/sleeve transporter 8 once again bypasses the diverter stretch 11 and, since the shunt 12 for the middle spinning frame 4 is rendered effective, also bypasses the ring spinning frame 4. In this case the path length is again approximately 8 times that of one stretch 10. However, the ring spinning frame 4 can nevertheless be serviced from the left-hand stretch of the track along ring-spinning machine 3 and the right-hand stretch of track along the ring spinning machine 5 which flank machine 4 since these stretches and the spindle rows of spinning frame 4 are within arms reach of servicing personnel, i.e. the stretches 10 carrying the transporter are within arms reach of the operator of frame 4.

It will, of course, be understood that the incorporation of a ring spinning machine in a particular loop or the omission of a ring spinning frame from a particular loop will require a corresponding resetting of the switch tracks of one or both loops involved to match the length of the loop to the length of the transporter 8.

As can be seen from FIG. 1, two drives 40 and 41 can be provided for each loop, each drive comprising a pair of friction rollers engaging the transporter 8 between them.

The gap 15 between the trailing end and the leading end of the bobbin/core transporter 8 must, as a function of the speed of the transporter be sufficient to allow a reliable resetting of a switch 14 in the gap. However the gap 15 should not be so great that the service person will have a long wait before bobbins arrive or the hangers for receiving the core sleeves can arrive and thereby limit the efficiency of the personnel. A suitable length of the gap 15 has been found to be between 2 m and 5 m.

The configurations of the path shown in FIGS. 1–3 allow incorporation in a loop of a ring-spinning machine from an adjoining group or omission of a ring-spinning machine at one side or the other side of the loop. When it is also desirable to drop one or more ring-spinning machines from a particular loop or to include one or more ring-spinning machines from another group, the more complex system of FIG. 4 can be used for the suspension track. In this case, three transverse tracks 17, 18, 19 are provided at one end of the array of ring-spinning machines and three transverse tracks 20, 21 and 22 are provided at the opposite end of the array of ring-spinning machines, these tracks being connected to the stretches 10 alongside the ring-spinning machines 27, 28, 2–5, 16, 29 via switches.

Figures 4, 5:
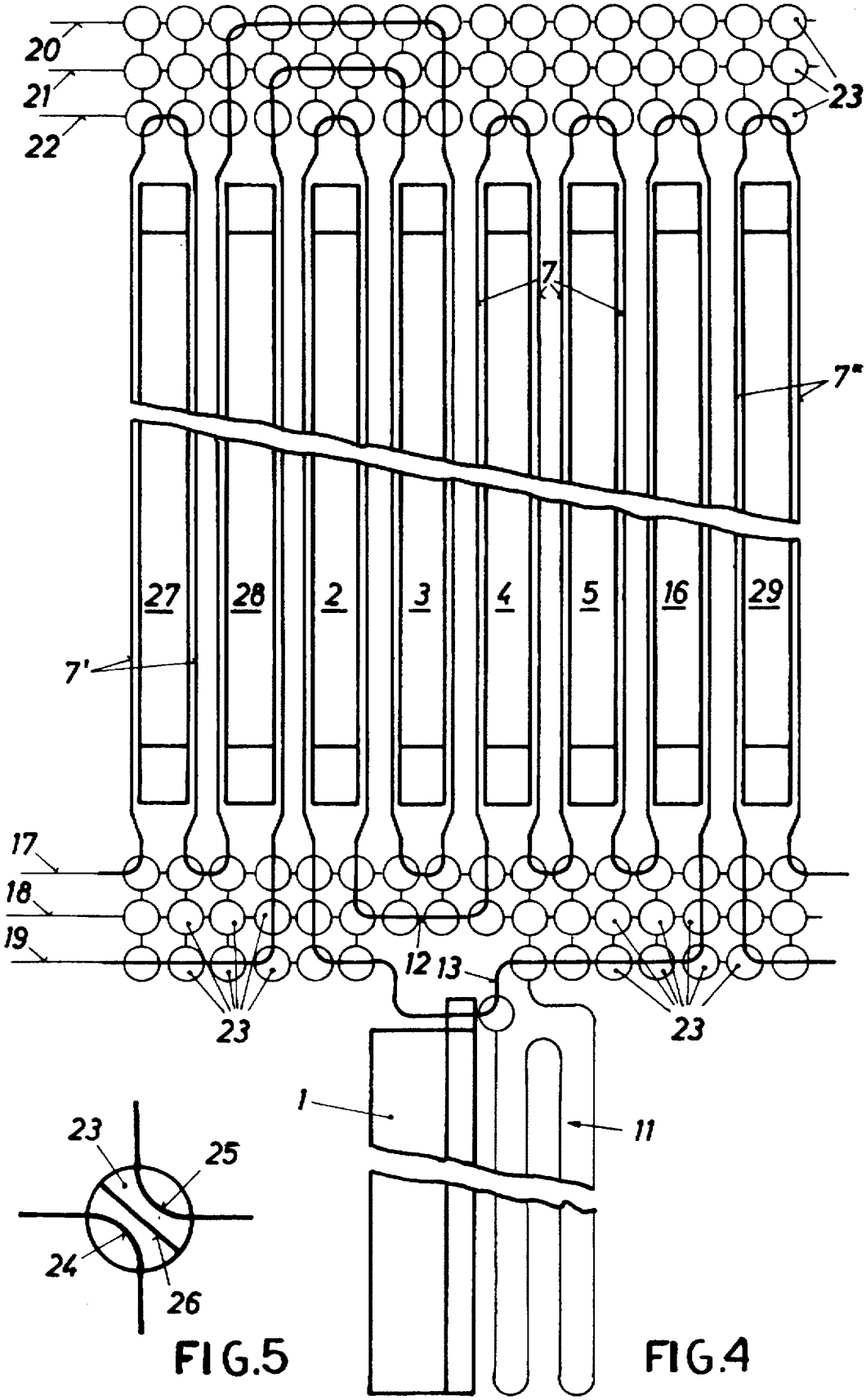
FIG. 4 is a plan view of another embodiment of the invention with a showing similar to that of FIGS. 1–3.
FIG. 5 is a detail of a switch for use in the system of FIG. 4.

The switches in this case can be rotary switch disks 23 with paths 24, 25 directing the transporter to the right or to the left, or the path 26, for directing the transporter in a straight line (see FIG. 5).

With corresponding settings of the disks 23, optional configurations of the suspension track loops 7, 7' and 7" is possible.

For example, in FIG. 4, the ring-spinning machines 2, 4, 5 and 16 may form one group serviced by the roving frame 1. The ring-spinning machine 3 belongs, together with the ring-spinning machines 27 and 28 to the group 7' to the left of the first-mentioned group and the roving frame of which has not been illustrated (but see FIG. 7). The ring-spinning machine 29 belongs to the group of ring-spinning machines which lie to the right of the group 7 and forms part of a further loop 7" which has been shown only incompletely.

The switch disks 23 have only been shown with respective paths for those switches which are effective. The settings of the other switch disks have not been illustrated. For other configurations of the loops, the other switches 23 can be used with corresponding settings.

The operation of the switches 14 is effected when the particular switch lies within the gap 15 as the transporter 8 travels continuously along the path. The switches can be set by hand although automatic switching is also possible.

Figure 6:
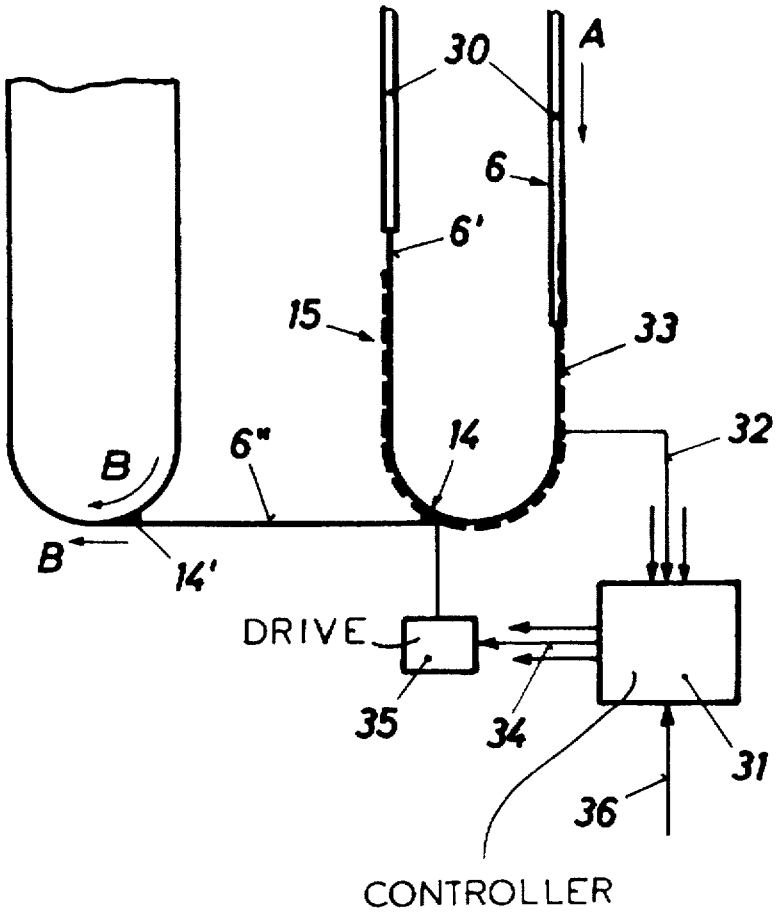
FIG. 6 is a plan view of a section of a track showing the effector for one of the switch tracks thereof.

FIG. 6 represents a diagram of an automatic controller.

In this case the moveable suspension carriages of the transporter 8 are assumed to be displaced in the direction of arrow A. The original path is shown in broken lines and extends between the track stretch 6 and the stretch 6'. The intended path is along the branch 6". The latter branch corresponds to the previously mentioned shunt 12. In this apparatus a controller 31 is provided which has a sensor 33 connected via the line 32 to the controller 31. The sensor 33 can extend along the entire broken line stretch shown in FIG. 6. The sensor can be a contact rail, a light curtain, an array of capacitative sensors or the like and detects the transporter 8 which can be in the form of the suspension carriage train represented at 30. When a switchover is desired, a command is delivered by the command line 36 to the controller 31 which is activated when the sensor 33 detects the arrival of the gap 15. When the gap arrives at the switch track 14, a signal is delivered via line 34 to the effector or drive 35 for the switch track 14, a signal is delivered via line 34 to the effector or drive 35 for the switch track 14 to switch the latter and allow the oncoming end of the transporter to travel onto the shunt 6".

The controller 31 is, as is represented by the further line connected thereto, equipped to control the switches of other loops 7, 7' or 7".

When the suspension carriage train 30 of the loop travels only in one direction, only such switches with respective effectors are required since switches on the opposite side of each switch unit, e.g. the switch 14, need not be actuated since the travel is always in one direction, namely, the direction represented by the arrows B.

As is also apparent from FIG. 1, the roving frame 1 can have a transfer station 1*a* at the end of this roving frame and through which the loop 7 can pass for transfer of the full bobbins to the transporter 8 and empty core sleeves from the transporter 8 to the roving frame.

Figure 9:
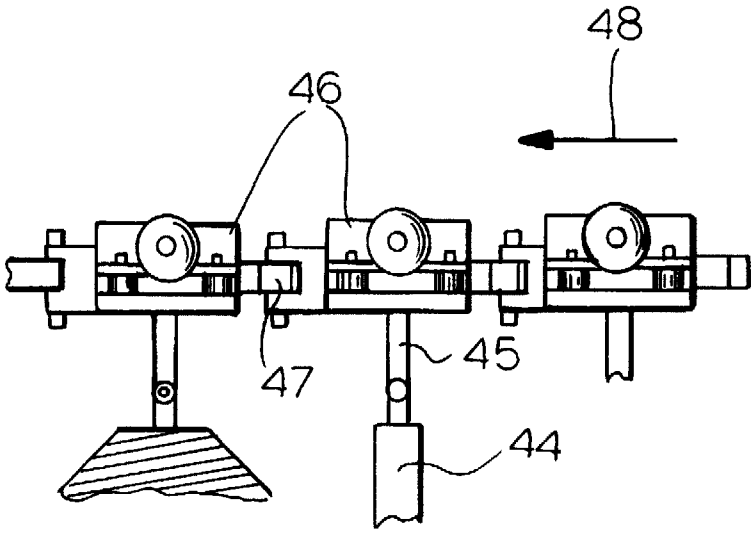
FIG. 9 is a fragmentary side elevational view of a transporter.
Figure 8:
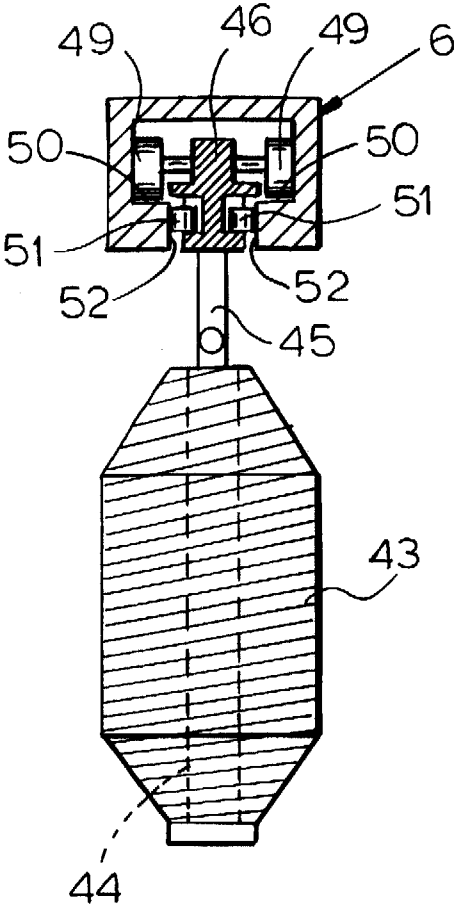
FIG. 8 is a cross sectional view through a transporter.

From FIG. 8 it will be apparent that the bobbins 43 can have core sleeves 44 which can be independently mounted on the hangers 45 (see FIGS. 8 and 9), each hanger 45 being affixed on a hanger carriage 46. The hanger carriages are articulated together at 47 without play so that the train is substantially rigid in the thrust direction 48 as well as under tension traction.

The carriages 46 may have rollers 49 supporting the transporter 8 on ledges 50 of the track 6 and lateral rollers 51 which ride along flanks 52 of these ledges.

We claim:

1. A textile plant comprising:

at least two upstream machines receiving respective cores and winding bobbins thereon;

a multiplicity of downstream machines for receiving wound bobbins and emptying said cores from said bobbins; and a transport system connecting each of said upstream machines with a respective and variable plurality of said downstream machines in a respective transport loop, said transport system comprising:

respective tracks extending along the downstream machines of the respective plurality and past the respective one of said upstream machines, respective shunts and switches connected to said tracks and selectively operable to vary a configuration of the respective transport loop to exclude a track of one of the respective plurality of upstream machines and to include a track of an upstream machine of another loop while maintaining substantially an original path length, and an elongated bobbin/core transporter displaceable along the respective transport loop for receiving wound bobbins from the respective upstream machine, for delivering wound bobbins to the downstream machines along the respective transport loop, for receiving cores from the respective downstream machines along the respective transport loop, and delivering said cores to the respective upstream machine, said transporter having a length slightly smaller than said path length.

2. The textile plant defined in claim 1 wherein one of said shunts bridges tracks of two of said upstream machines flanking another of said upstream machines of a respective plurality and is provided with respective switches selectively connecting said one of said shunts in the respective transport loop and disconnecting said one of said shunts from the respective transport loop.

3. The textile plant defined in claim 1, further comprising a diverting stretch in the form of a further loop connectable by respective one of said switches to the respective transport loop for receiving said transporter, said diverting stretch being short-circuitable by one of said shunts.

4. The textile plant defined in claim 3 wherein said diverting stretch has a length approximately equal to that of one of said tracks of one of said downstream machines.

5. The textile plant defined in claim 1 wherein said bobbin/core transporter is a chain of members which is substantially rigid in a thrust direction.

6. The textile plant defined in claim 1 wherein said bobbin/core transporter has a gap between ends thereof during travel of said transporter over the respective path, said system having sensors responsive to said gap and connected to a controller for effectors for operating said switches only while said gap extends across the respective switch.

7. The textile plant defined in claim 1 wherein said upstream machines are roving frames said downstream machines are ring spinning frames, said tracks are suspension tracks and said bobbin/core transporter is a train of hanger carriages having depending hangers engageable with said wound bobbins and said cores.

8. The textile plant defined in claim 7 wherein one of said shunts bridges tracks of two of said upstream machines flanking another of said upstream machines of a respective plurality and is provided with respective switches selectively connecting said one of said shunts in the respective transport loop and disconnecting said one of said shunts from the respective transport loop.

9. The textile plant defined in claim 8, further comprising a diverting stretch in the form of a further loop connectable by respective one of said switches to the respective transport loop for receiving said transporter, said diverting stretch being short-circuitable by one of said shunts.

10. The textile plant defined in claim 9 wherein said diverting stretch has a length approximately equal to that of one of said tracks of one of said downstream machines.

11. The textile plant defined in claim 10 wherein said train is substantially rigid in a thrust direction.

12. The textile plant defined in claim 10 wherein said bobbin/core transporter has a gap between ends thereof during travel of said transporter over the respective path, said system having sensors responsive to said gap and connected to a controller for effectors for operating said switches only while said gap extends across the respective switch.

* * * * *